US012162661B2

(12) United States Patent
Garnier et al.

(10) Patent No.: US 12,162,661 B2
(45) Date of Patent: Dec. 10, 2024

(54) CARTON AND CARTON BLANK

(71) Applicant: WestRock Packaging Systems, LLC, Atlanta, GA (US)

(72) Inventors: Jean-Michel Garnier, Issoudun (FR); Lauren N. Chesnet, Henrico, VA (US); Casey P. Grey, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/019,933

(22) PCT Filed: Aug. 4, 2021

(86) PCT No.: PCT/US2021/044494
§ 371 (c)(1),
(2) Date: Feb. 6, 2023

(87) PCT Pub. No.: WO2022/031814
PCT Pub. Date: Feb. 10, 2022

(65) Prior Publication Data

US 2023/0286714 A1 Sep. 14, 2023

Related U.S. Application Data

(60) Provisional application No. 63/062,902, filed on Aug. 7, 2020.

(51) Int. Cl.
*B65D 71/54* (2006.01)
*B65D 71/42* (2006.01)

(52) U.S. Cl.
CPC ..... *B65D 71/0007* (2013.01); *B65D 71/42* (2013.01); *B65D 2571/00141* (2013.01);
(Continued)

(58) Field of Classification Search
CPC .... B65D 71/00; B65D 71/0007; B65D 71/42; B65D 71/46; B65D 2571/00141;
(Continued)

(56) References Cited

U.S. PATENT DOCUMENTS 2,928,541 A * 3/1960 Fielding ..... B65D 71/16 206/427
5,355,999 A 10/1994 Sutherland
(Continued)

FOREIGN PATENT DOCUMENTS

FR 2715912 A1 8/1995

OTHER PUBLICATIONS

International Search Report issued in PCT/US2021/044494, datedNov. 15, 2021.

*Primary Examiner* — Bryon P Gehman
(74) *Attorney, Agent, or Firm* — Brian J. Goldberg; Rohini K. Garg

(57) ABSTRACT

Aspects of the disclosure relate to a package, a carton (90; 190) for packaging one or more articles and a blank (10; 110) for forming the carton (90; 190). The carton (90;190) comprises a wall having an outer panel (24A, 24B; 118, 120) and an inner panel (22A, 22B, 26A, 26B; 126A, 126B, 130A, 130B) at least partially overlapping the outer panel (24A, 24B; 118, 120). The inner panel (22A, 22B, 26A, 26B; 126A, 126B, 130A, 130B) comprises a cutaway (R; A2) defining at least in part a passage between the outer panel (24A, 24B; 118, 120) and an article B. The package comprises an adhesive bond between the outer panel (24A, 24B; 118, 120) and the article B, the adhesive bond extends through the passage.

20 Claims, 6 Drawing Sheets

(52) U.S. Cl.
CPC ..... *B65D 2571/00327* (2013.01); *B65D 2571/00456* (2013.01); *B65D 2571/0066* (2013.01); *B65D 2571/00728* (2013.01)

(58) Field of Classification Search
CPC ..... B65D 2571/00327; B65D 2571/00456; B65D 2571/0066; B65D 2571/00728; B65D 71/54; B65D 2571/000327
USPC ..... 206/427, 434
See application file for complete search history.

(56) References Cited

U.S. PATENT DOCUMENTS

| | | | | |
|---|---|---|---|---|
| 7,762,397 | B2 * | 7/2010 | Coltri-Johnson | B65D 71/30 206/427 |
| 8,757,380 | B2 * | 6/2014 | Loftin | B65D 71/36 206/427 |
| 11,027,904 | B2 * | 6/2021 | McCree | B65D 71/46 |
| 11,440,716 | B2 * | 9/2022 | Blin | B65D 71/42 |
| 2020/0189818 | A1 | 6/2020 | McCree et al. | |

* cited by examiner

CARTON AND CARTON BLANK

CROSS REFERENCE TO RELATED APPLICATIONS

This Application is a U.S. 371 National Phase Patent Application of International PCT Patent Application No. PCT/US2021/044494, filed Aug. 4, 2021, which claims priority to U.S. Provisional Patent Application No. 63/062,902, filed on Aug. 7, 2020. The entire contents of these applications are incorporated herein by reference.

TECHNICAL FIELD

The present invention relates to a carton for packaging one or more articles and a blank for forming the same, more specifically, but not exclusively to a carton having improved retention of articles.

BACKGROUND

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide a carton in which the articles being packaged are securely held within the carton. It is an object of the present disclosure to provide a carton which is adhesively secured to at least some of its contents. It is desirable that adhesive residue remains on the carton when the contents are removed.

The present invention seeks to overcome or at least mitigate the problems of the prior art.

SUMMARY

According to a first aspect of the present invention there is provided a package comprising a carton and at least one article. The carton comprises a wall having an outer panel and an inner panel at least partially overlapping the outer panel. The inner panel comprises a cutaway defining at least in part a passage between the outer panel and the article. The package comprises an adhesive bond between the outer panel and the article, the adhesive bond extends through the passage.

Optionally, the cutaway comprises one of the features selected from the following group; an aperture, a recess, an opening, a cut-out, a notch, and a slot.

Optionally, the cutaway defines an edge of the inner panel.

Optionally, the edge provides a knife to facilitate separation of the adhesive from the article.

Optionally, the cutaway defines at least a part of a boundary of a bonding region between the outer panel and the article.

Optionally, the carton comprises an opening through which a portion of the at least one article extends.

Optionally, the edge of the cutaway is disposed between the opening in the carton and the adhesive bond between the outer panel and the article.

Optionally, the carton comprises an opening through which a portion of the at least one article is accessible.

Optionally, the edge of the cutaway is disposed between the opening in the carton and the adhesive bond between the outer panel and the article.

Optionally, the wall is a side wall.

Optionally, the wall is an end wall.

According to a second aspect of the present invention there is provided a blank for forming a carton. The blank comprises a plurality of panels for defining an interior of the carton. The plurality of panels comprises a first wall panel and a second wall panel securable in at least partial overlapping, face contacting, relationship with the first wall panel. The first wall panel comprises a cutaway. In a setup carton, the cutaway defines a passage between the second wall panel and an article disposed adjacent to the first wall panel, through which passage an adhesive bond extends.

According to a third aspect of the present invention there is provided a carton for packaging at least one article. The carton comprises a plurality of panels for defining an interior of the carton. The plurality of panels comprises a first wall panel and a second wall panel securable in at least partial overlapping, face contacting, relationship with the first wall panel. The first wall panel comprises a cutaway, the cutaway defines a passage through the second wall panel through for forming an adhesive bond between the second wall panel and an article disposed adjacent to the first wall panel.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of packages, blanks and cartons are disclosed herein. It will be understood that the disclosed embodiments are merely examples of the way in which certain aspects of the invention can be implemented, and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
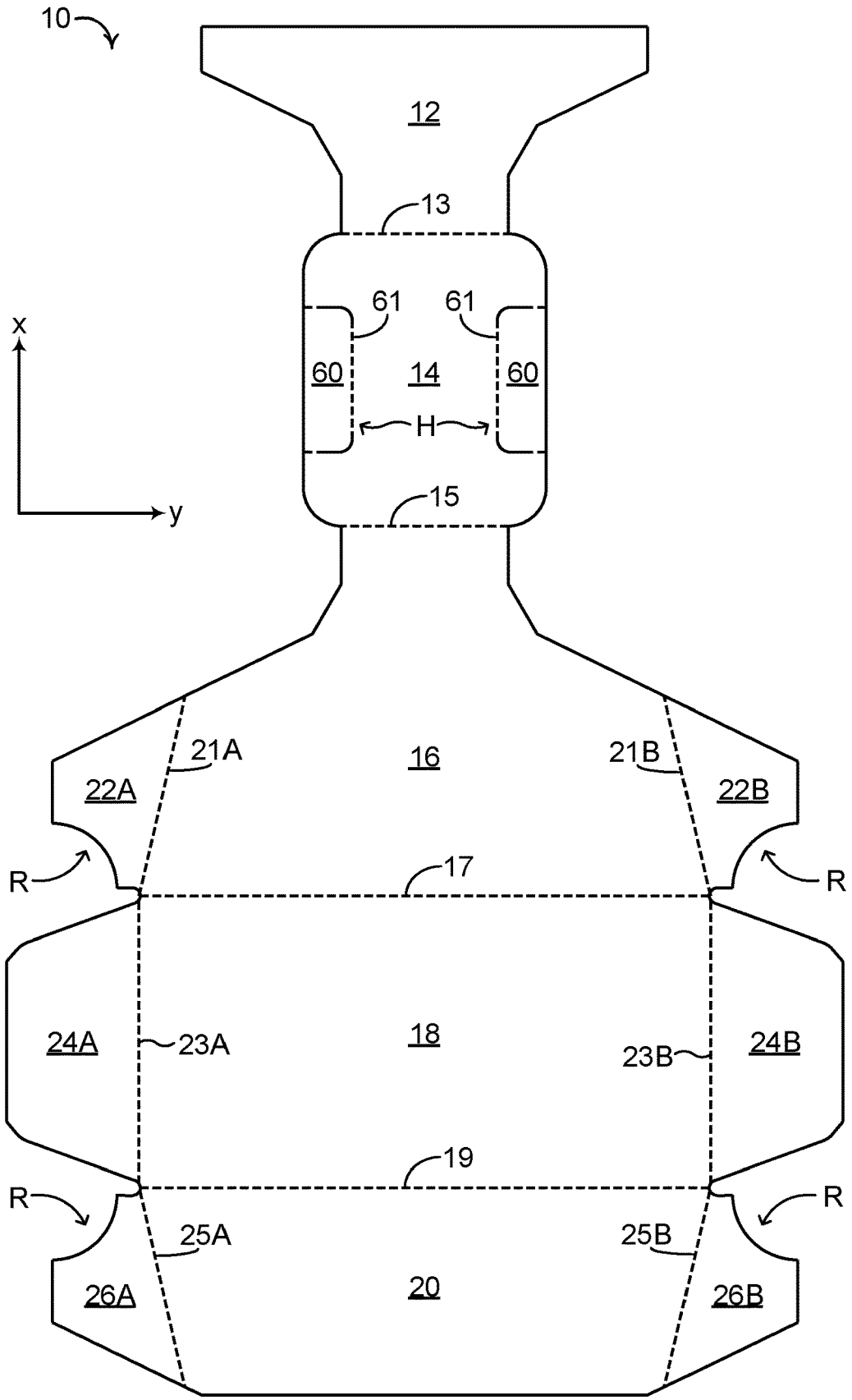
FIG. 1 is a plan view from above of a blank for forming a carton according to a first embodiment of the invention.
Figure 2:
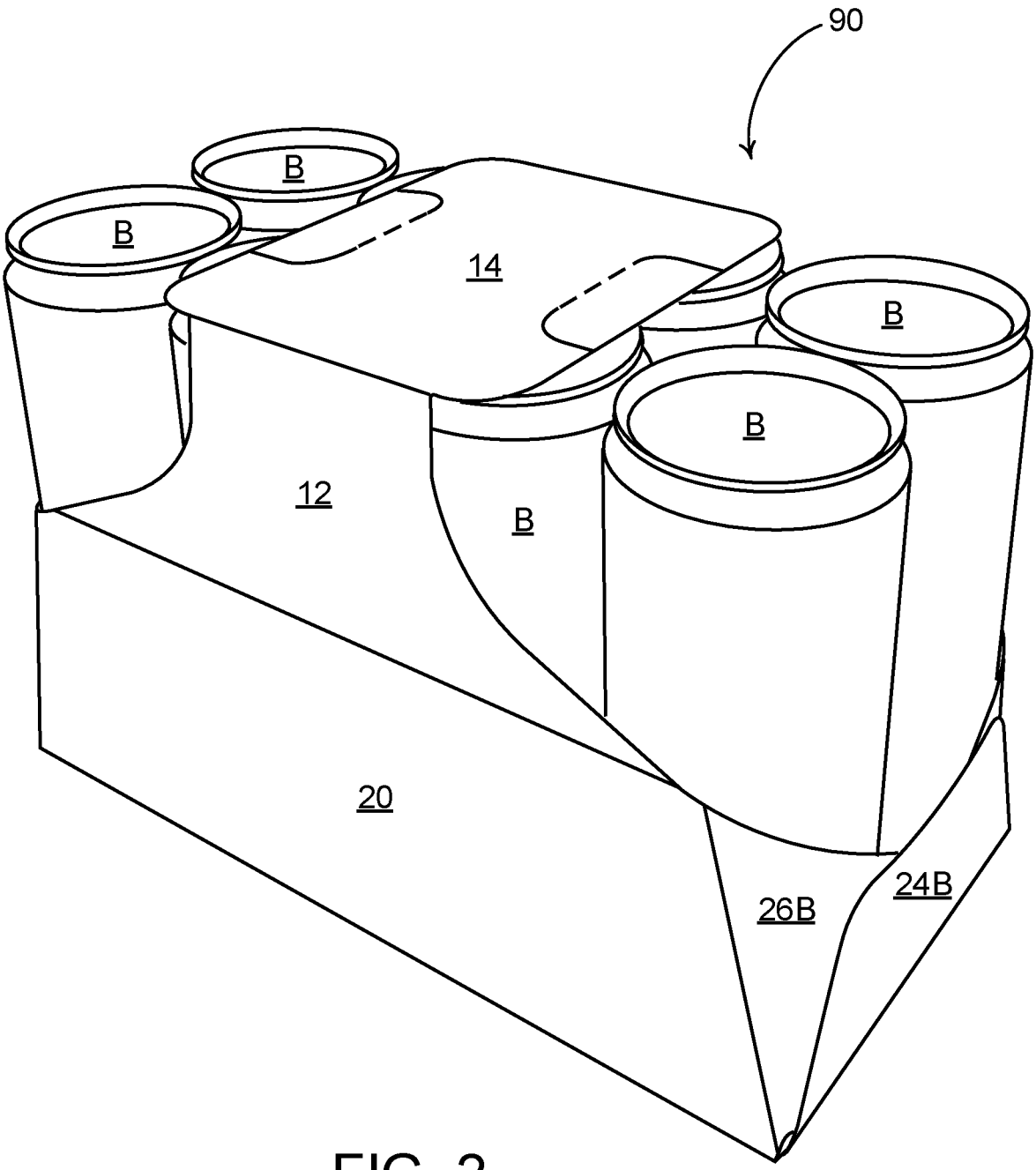
FIG. 2 is a perspective view of a carton formed from the blank of FIG. 1.
Figure 3:
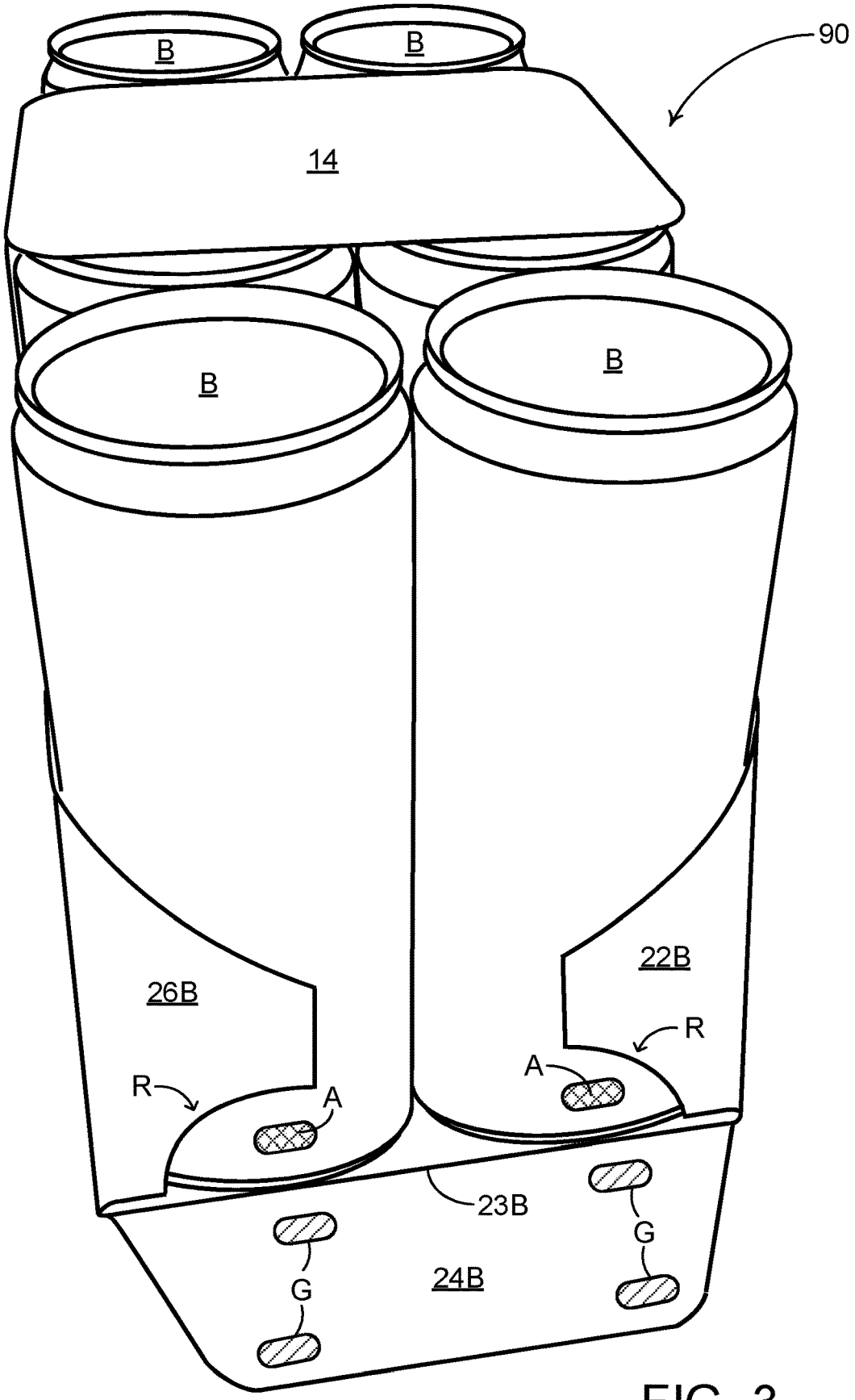
FIGS. 3 and 4 are perspective views of an end of the carton of FIG. 2 during stages of assembly.
Figure 4:
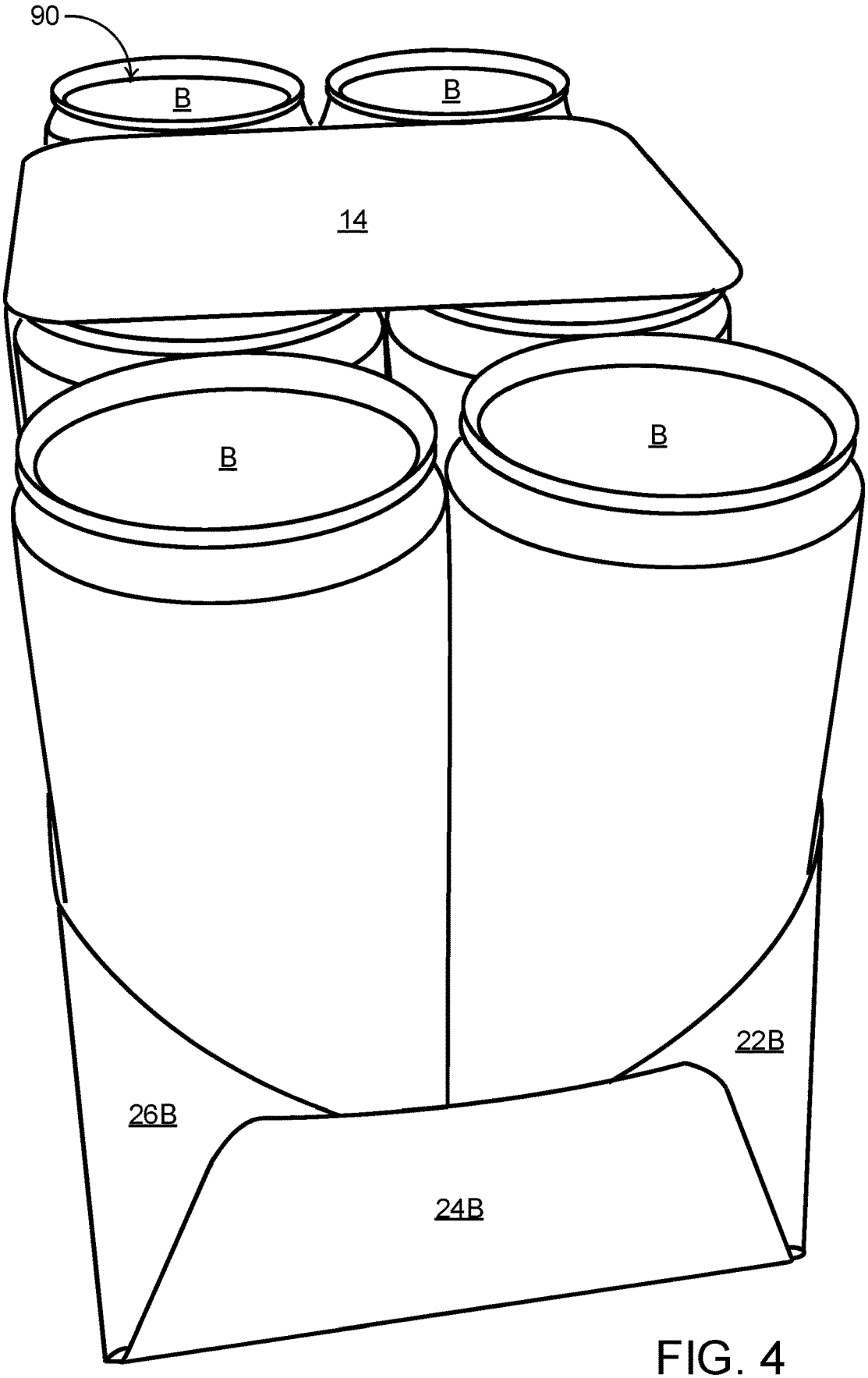

Referring to FIG. 1, there is shown a plan view of a blank 10 capable of forming a carton or carrier 90, as shown in FIGS. 2 to 4, which carton 90 can accept an input of primary products such as, but not limited to, bottles or cans, hereinafter referred to as "articles".

Figure 5:
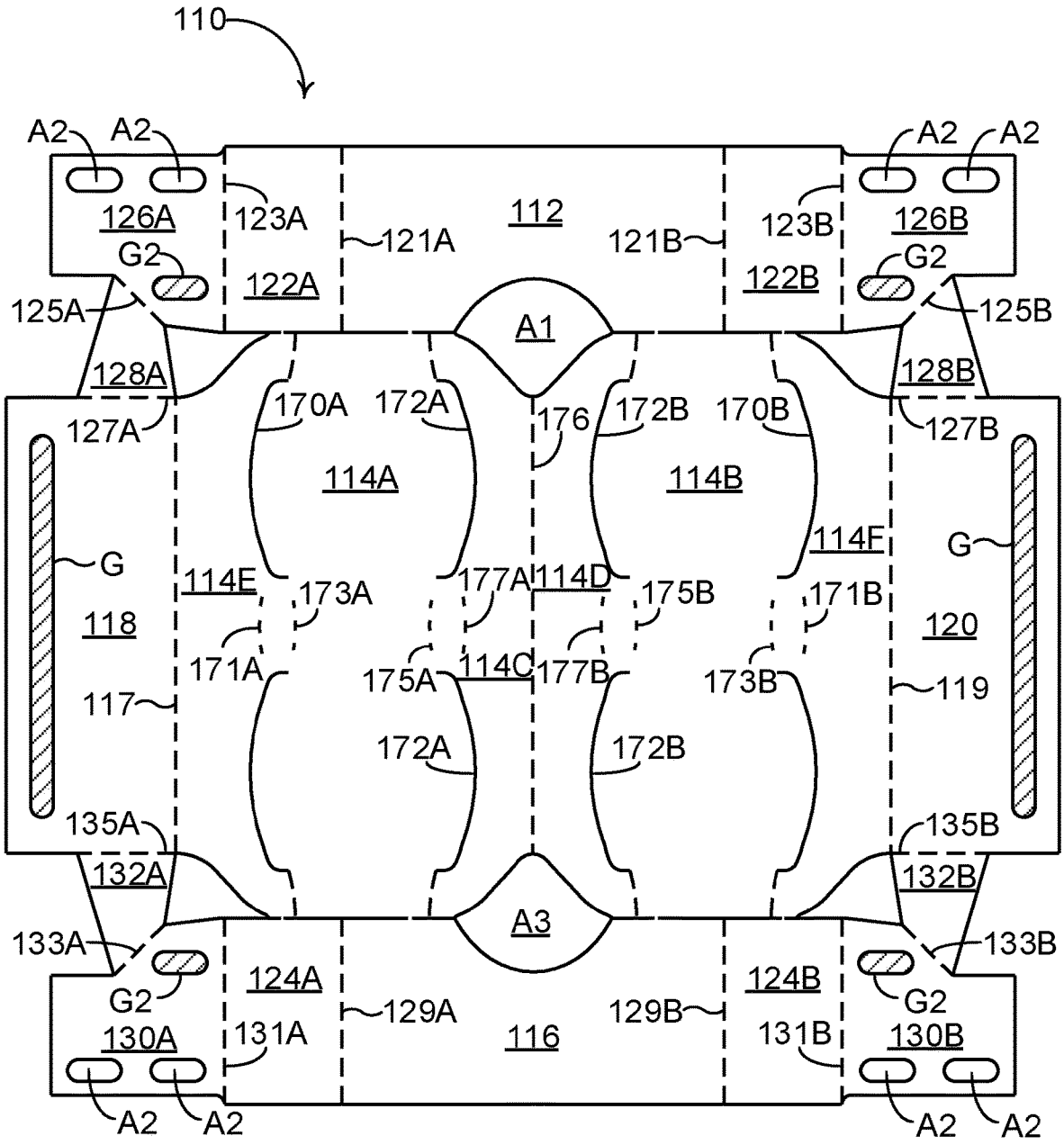
FIG. 5 is a plan view from above of a blank for forming a carton according to a second embodiment of the invention.
Figure 6:
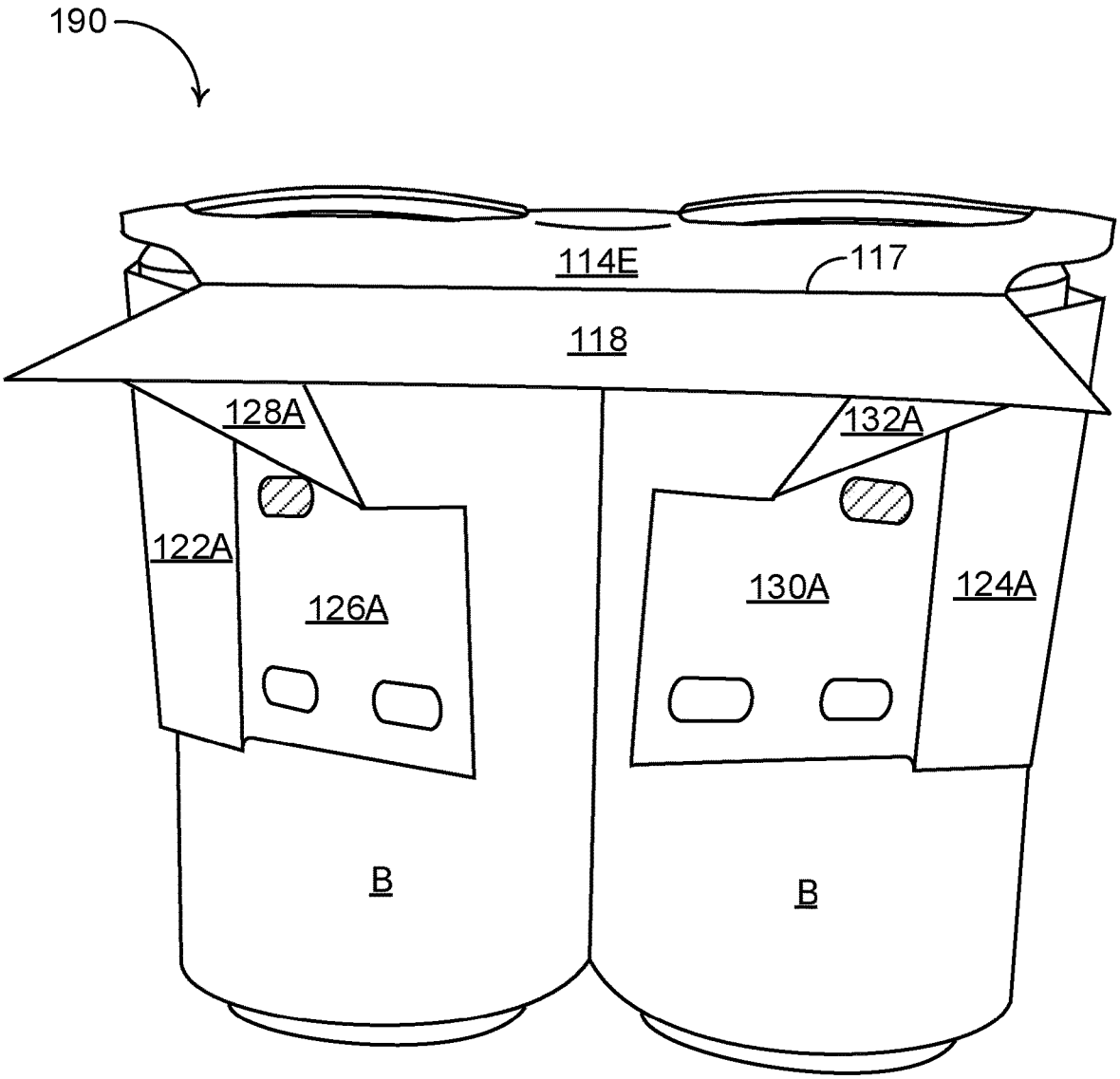
FIG. 6 is a perspective view of an end of a carton formed from the blank of FIG. 5 during a stage of assembly.

Referring to FIG. 5, there is shown a plan view of a blank 110 capable of forming a carton or carrier 190, as shown in FIG. 6, which carton 190 can accept an input of primary products such as, but not limited to, bottles or cans, hereinafter referred to as "articles".

In the embodiments detailed herein, the terms "carton" and "carrier" refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10; 110 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the embodiment illustrated in FIG. 1, the blank 10 is configured to form a carton or carrier for packaging an exemplary arrangement of exemplary articles. In the illustrated embodiment the arrangement is an m×n matrix or array, having three rows (m=3) and two columns (n=2); in the illustrated embodiment three rows of two articles are provided, and the articles are 330 ml cans; the cans may be formed from a suitable material such as, but not limited to, Aluminium.

In the embodiment illustrated in FIG. 5, the blank 110 is configured to form a carton or carrier for packaging an exemplary arrangement of exemplary articles. In the illustrated embodiment the arrangement is an m×n matrix or array, having two rows (m=2) and two columns (n=2); in the illustrated embodiment two rows of two articles are provided, and the articles are 12 fl. oz. (355 ml) cans.

The blanks 10; 110 can be alternatively configured to form a carrier 90; 190 for packaging other types, number and size of article and/or for packaging articles in a different arrangement or configuration.

Turning to FIG. 1, the blank 10 comprises a plurality of main panels 12, 14, 16, 18, 20 for forming a tubular structure or sleeve. The plurality of main panels 12, 14, 16, 18, 20 may be hinged one to the next in a linear series. A first main or first upper side wall panel 12 is hinged to a second main panel 14 (also referred to herein as a top panel 14) by a fold line 13. The top panel 14 is hinged to a third main panel 16 (also referred to herein as a second side wall panel 16) by a fold line 15. The second side wall panel 16 is hinged to a fourth main panel 18 (also referred to herein as a bottom panel 18) by a fold line 17. The bottom panel 18 is hinged to a fifth main panel 20 (also referred to herein as a first lower side wall panel 20) by a fold line 19. The first upper side wall panel 12 and first lower side wall panel 20 together form a composite panel 12/20 also referred to as first side wall 12/20.

The ends of the tubular structure are partially closed by end closure structures having a plurality of end closure panels 22A, 24A, 26A, 22B, 24B, 26B. A first end of the tubular structure is partially closed by a first group of end closure panels 22A, 24A, 26A; the second end of the tubular structure is partially closed by a second group of end closure panels 22B, 24B, 26B.

A first end closure panel 22A is hinged to a first end of the second side wall panel 16 by a fold line 21A; a second end closure panel 24A is hinged to a first end of the bottom panel 18 by a fold line 23A; a third end closure panel 26A is hinged to a first end of the first lower side wall panel 20 by a fold line 25A.

The first end closure panel 22A and third end closure panel 26A form minor or side end closure flaps 22A, 26A.

The second end closure panel 26A forms a major or bottom end closure flap 26A.

A fourth end closure panel 22B is hinged to a second end of the second side wall panel 16 by a fold line 21B; a fifth end closure panel 24B is hinged to a second end of the bottom panel 18 by a fold line 23B; a sixth end closure panel 26B is hinged to a second end of the first lower side wall panel 20 by a fold line 25B.

The fourth end closure panel 22B and sixth end closure panel 26B form minor or side end closure flaps 22B, 26B.

The fifth end closure panel 26B forms a major or bottom end closure flap 26B.

The top panel 14 is shorter in length in a longitudinal direction y than the bottom panel 18. The first side wall 12/20 and the second side wall panel 16 may be generally tapered in shape, in some embodiments they may be an inverted "T" shape or "hammerhead" shape.

The blank 10 may comprise a handle structure H. The handle structure H may be provided at least in part in the second main panel 14. The handle structure H comprises a pair of opposed handle tabs 60 struck from opposing end edges of the second main panel 14. Each handle tab 60 is struck from the second main panel 14 and is hinged connected thereto by a hinged connection in the form of a fold line 61.

Each of the first, third, fourth and sixth end closure panels 22A, 26A, 22B, 26B comprises a cutaway in the form or a recess R. The cutaway may be disposed at an end edge of the respective one of the first, third, fourth and sixth end closure panels 22A, 26A, 22B, 26B. The cutaway may be disposed at a lower edge of the respective one of the first, third, fourth and sixth end closure panels 22A, 26A, 22B, 26B. In this way a corner of the first, third, fourth and sixth end closure panels 22A, 26A, 22B, 26B may be chamfered or filleted. The chamfered or filleted corner or cutaway is configured to be proximate the bottom panel 18, adjacent one of the fold line 17,19, in a set up carton 90, best shown in FIG. 3.

The cutaway exposes a portion of an article B, see FIG. 3, disposed adjacent to the respective one of the first, third, fourth and sixth end closure panels 22A, 26A, 22B, 26B; the cutaway may expose a lower or heel portion of said article B.

Turning to the construction of the carton 90 as illustrated in FIG. 2, the carton 90 can be formed by a series of sequential folding operations in a straight-line machine so that the carton is not required to be rotated or inverted to complete its construction. The folding process is not limited to that described below and may be altered according to particular manufacturing requirements.

The blank 10 is folded about the fold line 15 such that the first main panel 12 is brought into face to face relationship with a portion of the third main panel 16 and the fourth main panel 18 and the second main panel 14 is brought into face to face relationship with the third main panel 16.

Glue G or other adhesive treatment is applied to the first main panel 12. In alternative embodiments glue or other adhesive treatment may be applied to the fifth main panel 20.

The fifth main panel 20 is folded about fold line 19 into partial overlapping face to face relationship with the first main panel 14. The fifth main panel 20 is secured to the first main panel 12.

In this way a flat collapsed tubular structure is formed. This flat collapsed tubular structure is suitable for shipping or distribution to a convertor plant.

The flat collapsed tubular structure can be erected into a carton by forming a tubular structure, engaging an adjacent pair of the plurality of main panels 12/20, 14, 16, 18 and orientating an adjacent pair of the plurality of main panels 12/20, 14, 16, 18 so as to be substantially perpendicular to each other. The tubular structure can then be loaded with articles B by inserting the articles B through one or both of the open ends of the tubular structure. The ends of the tubular structure are closed by folding the end closure panels 22A, 24A, 26A, 22B, 24B, 26B to be substantially perpendicular to the one of the walls 12/20, 14, 16, 18 of the carton 90 to which they are hinged.

The first end closure panel 22A is folded to be substantially perpendicular to the third main wall panel 16. The third end closure panel 26A is folded to be substantially perpendicular to the fifth main panel 20.

The second end closure panel 24A is folded to be substantially perpendicular to the fourth main panel 18 such that it is in face contacting relationship with the first and third end closure panels 22A, 26A. The second end closure panel 24A is secured to the first and third end closure panels 22A, 26A by adhesive or other suitable treatment. The second end closure panel 24A is secured to endmost articles B by adhesive or other suitable treatment.

The fourth end closure panel 22B is folded to be substantially perpendicular to the third main wall panel 16. The sixth end closure panel 26B is folded to be substantially perpendicular to the fifth main panel 20.

Glue G or other adhesive treatment is applied to the fifth end closure panel 24B, see FIG. 3.

The fifth end closure panel 24B is folded to be substantially perpendicular to the fourth main panel 18 such that it is in face contacting relationship with the fourth and sixth end closure panels 22B, 26B, as shown in FIG. 4.

The fifth end closure panel 24B is secured to the fourth and sixth end closure panels 22B, 26B. The fifth end closure panel 24B is adhesively secured to endmost articles B, via the cutaways in the fourth and sixth end closure panels 22B, 26B. FIG. 3 illustrates a securing region A on each of a pair of endmost articles B disposed adjacent to the fifth end closure panel 24B. An edge of the first, second, fourth and sixth end closure panels 22A, 26A, 22B, 26B defined by the cutaway limits spread of the adhesive over the article B.

The assembled carton 90 is shown in FIGS. 2 and 4. The central or intermediate articles B are disposed below the top panel 14. The carton 90 comprises openings or windows in at least one of the upper corners, when the carton 90 is at rest upon the base wall 18. Upper ends or regions of endmost articles B, where the endmost articles B are disposed adjacent or proximate to the end closures formed from the end closure panels 22A, 24A, 26A, 22B, 24B, 26B. The upper ends of the endmost articles B may be fully exposed such that the articles B can be removed through a respective one of the windows or openings.

Removal of the endmost articles B is inhibited by the adhesive bond to the base end closure panels 24A, 24B. The articles B can be removed from the carton 90 by breaking the adhesive bond between the article B and the carton 90. The adhesive bond extends between the article B and a respective one of the base end closure panels 24A, 24B, the adhesive bond extends through the cutaway or recess R. A portion of one of the side end closure panels 22A, 22B, 26A, 26B is disposed between the adhesive bond and the opening or window in the carton 90; said portion the side end closure panels 22A, 22B, 26A, 26B may form a knife edge, blade or scraper so as to encourage separation of the adhesive's bond to the article B and retain the adhesive's bond or attachment with the base end closure panel 24A, 24B. The cutaway or recess R may also serve to limit the spread of adhesive and restrict the size of the bond area between the base end closure panels 24A, 24B and the article B.

Referring now to FIGS. 5 and 6, there is shown an additional embodiment of the present disclosure. In the second illustrated embodiment like numerals have, where possible, been used to denote like parts, albeit with the addition of the prefix "100" to indicate that these features belong to the second embodiment. The additional embodiment shares many common features with the previous embodiment and therefore only the differences from the embodiment illustrated in FIGS. 1 to 4 will be described in detail.

FIGS. 5 and 6 illustrate a blank 110 for forming a carrier 190 respectively. The second embodiment comprises a plurality of panels 112, 114, 116, 118, 120, including a main panel for forming a top wall or an engaging panel of a carrier.

The blank 110 includes a first side panel 118 hingedly connected to a first side of the main panel 114 by a hinged connection in the form of a fold line 117, more specifically the first side panel 118 is hingedly connected to a first outer shoulder panel 114E forming part of the main panel 114. The blank 110 includes a second side panel 120 hingedly connected to a second side of the main panel 114 by a hinged connection in the form of a fold line 119, more specifically the second side panel 120 is hingedly connected to a second outer shoulder panel 114F forming part of the main panel 114.

The first outer shoulder panel 114E is hinged to a first top panel 114A by a hinged connection in the form of a fold line 173A. The second outer shoulder panel 114F is hinged to a second top panel 114B by a hinged connection in the form of a fold line 173B. The main panel 114 further comprises a first inner shoulder panel 114C and a second inner shoulder panel 114D.

The first inner shoulder panel 114C is hinged to a first top panel 114A by a hinged connection in the form of a fold line 175A. The first inner shoulder panel 114C is hinged to the second inner shoulder panel 114D by a hinged connection in the form of a fold line 176. The second inner shoulder panel 114D is hinged to the second top panel 114B by a hinged connection in the form of a fold line 175B.

The first inner shoulder panel 114C and the second inner shoulder panel 114D form a keel structure disposed between two rows of articles B.

Each of the first and second top panels 114A, 114B includes opposed pairs of article-engaging devices 170A, 172A (and 170B, 172B) formed therein and generally along respective fold lines 173A, 175A (and 173B, 175B). Fold lines 173A, 175A hingedly interconnect the respective series of article-engaging devices 170A, 172A. Fold lines 173B, 175B hingedly interconnect the respective series of article-engaging devices 170B, 172B. In the illustrated embodiment, each of the article-engaging devices 170A, 172A, 170B, 172B takes the form of a curved slit. The slits may be considered to interrupt a respective one of the fold lines 173A, 175A, 173B, 175B, between the first and second top panels 114A, 114B and the inner and outer shoulder panels 114C, 114D, 114E, 114F. In other embodiments, each of the article-engaging devices may be formed by a series of curved frangible lines. In other embodiments, the article-engaging devices 170A, 172A, 170B, 172B may comprise apertures for receiving upper parts of articles B held by the carrier 190. It will be understood that many mechanisms exist for clipping, locking, or engaging the tops or other portions of articles B (such as radially protruding portions or flanges) for holding the articles B in an assembled and secure group so that a number of articles B may easily be purchased and transported at the same time. In the illustrated embodiment, the article-engaging devices 170A, 172A, 170B, 172B take the form of C-shaped slits which form openings when the top panels 114A, 114B are folded about the fold lines 173A, 175A, 173B, 775B, each thereby providing an article-engaging edge. Once opened, the slits are sized similarly to or substantially equal to the rim edge of an article B. Each article-engaging device 170A, 172A, 170B, 172B provides a pair of openings for receiving a portion of an article B.

In the illustrated embodiment, the fold lines 173A, 175A (and 173B, 175B) that hingedly interconnect the series of article-engaging devices 170A, 172A (and 170B, 172B) are slightly arcuate in shape (in other embodiments they may be linear or straight) with their convex sides disposed toward the interiors of respective adjacent top panels 114A, 114B.

First and second outer shoulder panels 114E, 114F each include one or more second or stress-reducing fold lines 171A, 171B that extend alongside at least part of respective fold lines 173A, 173B. In the illustrated embodiment, stress-reducing fold lines 171A, 171B are generally arcuate (in other embodiments they may be linear or straight) with their concave sides disposed toward the interiors of respective adjacent top panels 114A, 114B. The stress-reducing fold lines 171A, 171B can be disposed between two adjacent ones of cut lines 170A, 170B.

In the illustrated embodiment, first and second inner shoulder panels 114C, 114D also include one or more second or stress-reducing fold lines 177A, 177B that extend alongside at least part of respective fold lines 175A, 175B. Stress-reducing fold lines 177A, 177B may generally mirror the stress-reducing fold lines 171A, 171B disposed on the first and second outer shoulder panels 114E, 114F. Stress-reducing fold lines 177A, 177B may facilitate the contouring of inner shoulder panels 114C, 114D to corresponding portions of the necks of adjacent articles.

The outermost edges of the inner shoulder panels 114C, 114D are defined at least in part by a cutaway in the form of an aperture A1, A3. The apertures A1, A3 may define at least in part a recess or cutaway in an upper edge of an end panel 112, 116.

The blank 110 comprises a first end strap 126A/122A/112/122B/126B and a second end strap 130A/124A/116/124B/130B.

The first end strap 126A/122A/112/122B/126B comprises a first end panel 112. A first corner panel 122A is hingedly connected to a first end of the first end panel 112 by a hinged connection in the form of a fold line 121A. A first securing panel 126A is hingedly connected to an end of the first corner panel 122A by a hinged connection in the form of a fold line 123A. A first gusset panel 128A is hingedly interconnected between the first securing panel 126A and a first end of the first side panel 118 by fold lines 125A, 127A.

A second corner panel 122B is hingedly connected to a second end of the first end panel 112 by a hinged connection in the form of a fold line 121B. A second securing panel 126B is hingedly connected to an end of the second corner panel 122B by a hinged connection in the form of a fold line 123B. A second gusset panel 128B is hingedly interconnected between the second securing panel 126B and a first end of the second side panel 120 by fold lines 125B, 127B.

The first end panel 112 is separated from, or severable from, the main panel 114. The blank may comprise at least one cut line or frangible line for severing the first end panel 112 from the main panel 114.

The first corner panel 122A is separated from the main panel 114. The blank 110 may comprise an aperture separating, at least in part, the first corner panel 122A from the main panel 114. The first corner panel 122A may be separated, at least in part, from the main panel 114 by a cut line or frangible line.

The second corner panel 122B is separated from the main panel 114. The blank 110 comprises an aperture separating, at least in part, the second corner panel 122B from the main panel 114. The second corner panel 122B may be separated, at least in part, from the main panel 114 by a cut line or frangible line.

The first end strap 126A/122A/112/122B/126B forms a first end wall of the carrier.

The second end strap 130A/124A/116/124B/130B comprises a second end panel 116. A third corner panel 124A is hingedly connected to a first end of the second end panel 116 by a hinged connection in the form of a fold line 129A. A third securing panel 130A is hingedly connected to an end of the third corner panel 124A by a hinged connection in the form of a fold line 131A. A third gusset panel 132A is hingedly interconnected between the third securing panel 130A and a second end of the first side panel 118 by fold lines 133A, 135A.

A fourth corner panel 124B is hingedly connected to a second end of the second end panel by a hinged connection in the form of a fold line 129B. A fourth securing panel 130B is hingedly connected to an end of the fourth corner panel 124B by a hinged connection in the form of a fold line 131B. A fourth gusset panel 132B is hingedly interconnected between the fourth securing panel 130B and a second end of the second side panel 120 by fold lines 133B, 135B.

The second end panel 116 is separated from, or severable from, the main panel 114. The blank 110 may comprise at least one cut line or frangible line severing the second end panel 116 from the main panel 114.

The third corner panel 124A is separated from the main panel 114. The blank 110 comprises an aperture separating, at least in part, the third corner panel 124A from the main panel 114. The third corner panel 124A may be separated, at least in part, from the main panel 114 by a cut line or frangible line.

The fourth corner panel 124B is separated from the main panel 114. The blank 110 comprises an aperture separating, at least in part, the fourth corner panel 124B from the main panel 112. The fourth corner panel 124B may be separated, at least in part, from the main panel 114 by a cut line or frangible line.

The second end strap 130A/124A/116/124B/130B forms a second end wall of the carrier.

In the second illustrated embodiment the first side panel 118 and the second side panel 120 each comprise at least one article glue location G on inner surfaces thereof, at which article glue location G the first and second side panels 118, 120 are adhesively secured to two of the adjacently disposed articles B. Glue or adhesive is applied to the article glue locations G.

Each of a first securing panel 126A, a second securing panel 126B, a third securing panel 130A and a fourth securing panel 130B comprises at least one cutaway A2, optionally two cutaways A2, in the form of apertures.

The cutaways A2 in the first securing panel 126A and the third securing panel 130A are arranged to overlap with a glue location G on the first side panel 118. The cutaways A2 in the second securing panel 126B and the fourth securing panel 130B are arranged to overlap with a glue location G on the second side panel 120.

The cutaways A2 facilitate securing the first side panel 118 and the second side panel 120 to adjacently disposed articles B. An adhesive bond is formed through the first securing panel 126A, the second securing panel 126B, the third securing panel 130A and the fourth securing panel 130B.

Each of the first securing panel 126A, the second securing panel 126B, the third securing panel 130A and the fourth securing panel 130B comprises a panel glue location G2 on an outer surface thereof, at which panel glue locations G2 the first and second side panels 118, 120 are adhesively securable to a respective one of the gusset panels 128A, 128B, 132A, 132B. Glue or adhesive is applied to the panel glue locations G2.

The panel glue locations G2 facilitate securing the end straps 126A/122A/112/122B/126B, 130A/124A/116/124B/130B in position.

An edge of the first securing panel 126A, the second securing panel 126B, the third securing panel 130A and the fourth securing panel 130B defined by the cutaways A2 may form a knife edge, blade or scraper so as to encourage separation of the glue's bond to the article B and retain the glue's bond or attachment to the respective one of the first side panel 118 and the second side panel 120. The cutaway A2 may also serve to limit the spread of adhesive and restrict the size of the bond area between said one of the first side panel 118 and the second side panel 120. and the article B.

A carton 190 formed from the blank 110 is shown in FIG. 6, the carton 190 is of the top gripping type. An end, a lower end, of each article B is exposed or outside of the carton 190. The lower ends of the articles B are readily accessed without requiring access to an interior of the carton 190.

The cutaways A2 are arranged to be in registry, or alignment with the one of the article glue locations G when the securing panels 126A, 126B, 130A, 130B are in face to face relationship with a respective one of the side panels 118, 120 glue or adhesive applied to the article glue locations G passes through the cutaways A2 so as to secure the side panels 118, 120 to one or more adjacently disposed articles B.

The present disclosure provides a carton 90;190 and a blank 10; 110 for forming the carton 90. The carton 90; 190 forms a package with at least one article B. The carton 90; 190 comprises a wall formed from a first, outer layer or panel 24A, 24B; 118, 120 and a second, inner, layer or panel 22A, 22B, 26A, 26B; 126A, 126B,130A, 130B. The second, inner, layer or panel 22A, 22B, 26A, 26B; 126A, 126B, 130A, 130B comprises a cutaway R; A2 defining at least in part a passage between the first, outer layer or panel 24A, 24B; 118, 120 and the article B. The cutaway R; A2 may take the form of an aperture, recess, opening, cutout, notch, or slot. The package comprises an adhesive bond between the first, outer layer or panel 24A, 24B; 118, 120 and the article B, the adhesive bond extending through the passage.

The cutaway R; A2 defines an edge of the second, inner, layer or panel 22A, 22B, 26A, 26B; 126A, 126B,130A, 130B. The edge may facilitate separation of the glue or adhesive from the article B and may act as a knife.

The cutaway R; A2 may define at least a part of a perimeter or boundary of a bonding region between the first, outer layer or panel 24A, 24B; 118, 120 and the article B.

The carton 90; 190 may comprise an opening through which a portion of the at least one article B extends or is accessible.

The edge may facilitate shearing the glue or adhesive from the article B when it is pulled out of the carton 90; 190 through the opening 90; 190.

The edge of the cutaway R; A2 is disposed between the opening in the carton 90; 190 and the adhesive bond between the first, outer layer or panel 24A, 24B; 118, 120 and the article B.

A fugitive glue may be employed to secure the side or end panels to the articles. An example of a specific glue is Swift®melt 7044 manufactured by HB Fuller. Use of a fugitive glue is optional, an advantage of a fugitive glue is its tendency to remain attached to the carrier when the articles are disengaged from the carrier (this may be more desirable than having the glue remain attached to the articles). In alternative embodiments other adhesives maybe employed such as, but not limited to, hot-melt glue.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to "hinged connection" or "fold line" should not be construed as necessarily referring to a single fold line only; indeed it is envisaged that a hinged connection can be formed from any one or more of the following: a short slit, a frangible line or a fold line without departing from the scope of the invention.

As used herein, the term "severance line" refers to all manner of lines that facilitate separating portions of the substrate from one another, or that indicate optimal separation locations. Severance lines may be frangible or otherwise weakened lines, tear lines, cut lines, or slits.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A package comprising a carton and at least one article, the carton comprising a plurality of panels for forming a tubular structure defining an interior space within the carton, the plurality of panels comprising an outer panel and an inner panel at least partially overlapping the outer panel, wherein the inner panel is disposed closer to the interior space and the outer panel is disposes farther away from the interior space, the inner panel comprising a cutaway defining at least in part a passage between the outer panel and the at least one article, wherein the package comprises an adhesive bond between the outer panel and the at least one article, the adhesive bond extending through the passage.

2. A package according to claim 1 wherein the cutaway comprises one of the features selected from the following: an aperture, a recess, an opening, a cut-out, a notch, and a slot.

3. A package according to claim 1 wherein the cutaway defines an edge of the inner panel.

4. A package according to claim 3 wherein the edge provides a knife to facilitate separation of the adhesive from the at least one article.

5. A package according to claim 3 wherein the carton comprises an opening through which a portion of the at least one article extends.

6. A package according to claim 5 wherein the edge is disposed between the opening in the carton and the adhesive bond between the outer panel and the at least one article.

7. A package according to claim 3 wherein the carton comprises an opening through which a portion of the at least one article is accessible.

8. A package according to claim 7 wherein the edge is disposed between the opening in the carton and the adhesive bond between the outer panel and the at least one article.

9. A package according to claim 1 wherein the cutaway defines at least a part of a boundary of a bonding region between the outer panel and the at least one article.

10. A package according to claim 1 wherein the wall is a side wall.

11. A package according to claim 1 wherein the wall is an end wall.

12. A blank for forming a carton, the blank comprising a plurality of panels for defining an interior of the carton, the plurality of panels comprising:

a first wall panel;

a second wall panel securable in at least partial overlapping, face contacting, relationship with the first wall panel;

wherein the first wall panel comprises a cutaway and the cutaway defines a passage between the second wall panel and an article disposed adjacent to the first wall panel for forming an adhesive bond through the passage in a setup carton.

13. The carton according to claim 12 wherein the cutaway defines an edge of the first wall panel.

14. The carton according to claim 12 wherein the cutaway defines at least a part of a boundary of a bonding region between the second wall panel and the at least one article.

15. The carton according to claim 12 further comprises an opening through which a portion of the at least one article is accessible.

16. The carton to claim 15, wherein an edge defined at least in part by the cutaway is disposed between the opening and the adhesive bond between the second wall panel and the at least one article.

17. The carton according to claim 12 further comprises an opening through which a portion of the at least one article extends, wherein an edge defined at least in part by the cutaway is disposed between the opening and the adhesive bond between the second wall panel and the at least one article.

18. A carton for packaging at least one article, the carton comprising a plurality of panels for defining an interior of the carton, the plurality of panels comprising:

a first wall panel;

a second wall panel securable in at least partial overlapping, face contacting, relationship with the first wall panel;

wherein the first wall panel comprises a cutaway, the cutaway defines a passage for forming an adhesive bond between the second wall panel and the at least one article disposed adjacent to the first wall panel via the passage.

19. The blank according to claim 18 wherein the cutaway of the first wall panel.

20. The blank according to claim 18 wherein the cutaway defines at least a part of a boundary of a bonding region between the second wall panel and the article.

* * * * *